US006733608B1

(12) United States Patent
Baggot et al.

(10) Patent No.: US 6,733,608 B1
(45) **Date of Patent: *May 11, 2004**

(54) METHODS FOR MAKING AND PROCESSING HIGH BULK TISSUE WEBS

(75) Inventors: James Leo Baggot, Menasha, WI (US); Michael Earl Daniels, Neenah, WI (US); Ronald Frederick Gropp, St. Catherine's (CA); David Robert Gruber, Aiken, SC (US); Paul Kerner Pauling, Appleton, WI (US); James Monroe Perkins, Appleton, WI (US); James B. Ba Dour, Jr., Green Bay, WI (US); Larry E. Birnbaum, Green Bay, WI (US); Rudolph S. Fortuna, Green Bay, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/049,908

(22) Filed: Mar. 30, 1998

Related U.S. Application Data

(63) Continuation-in-part of application No. 08/845,098, filed on Apr. 16, 1997, now Pat. No. 6,030,496.

(51) Int. Cl.[7] ..... B65H 19/18

(52) U.S. Cl. ..... 156/157; 156/209; 156/285; 156/504; 162/118; 162/283; 242/555.3; 242/556

(58) Field of Search ..... 156/504, 62.2, 156/157, 159, 184, 209, 219, 285; 162/118, 122, 109, 120, 283; 226/91, 92; 279/4.03; 242/555, 555.3, 555.5, 555.6, 555.7, 556

(56) References Cited

U.S. PATENT DOCUMENTS 1,788,648 A 1/1931 Wood
2,617,606 A * 11/1952 Whatmore ..... 242/58

(List continued on next page.)

FOREIGN PATENT DOCUMENTS

DE 1 965 648 9/1970 ..... B65H/45/09
EP 0 254 006 A1 1/1988 ..... B65H/19/12

(List continued on next page.)

*Primary Examiner*—Gladys J P Corcoran
(74) *Attorney, Agent, or Firm*—Patricia A. Charlier; Douglas G. Glantz

(57) ABSTRACT

A method for processing high bulk tissue webs is disclosed for forming a wet web, drying the web, winding the dried web to form a plurality of parent rolls, unwinding the parent rolls by transmitting torque through the roll center and/or ends, moving the partially unwound roll to effect splicing with a subsequent parent roll, and rewinding the thus united web. In particular embodiments, the torque transmitting means comprise side clamping mechanisms that engage only the end surfaces of the parent rolls. In other embodiments, an automated off-line method for splicing tissue webs from different parent rolls utilizes a finishing unit that substantially continuously impacts each web during unwinding to splice the webs together. In one aspect, a method of making and processing high bulk tissue webs is disclosed for the production of a soft, high bulk uncreped throughdried tissue web by depositing an aqueous suspension of paper-making fibers onto an endless forming fabric to form a web and drying the web by throughdrying to final dryness without any significant differential compression to form a dried web having a bulk value of about 15 to 25 cubic centimeters per gram or greater, an MD Stiffness Factor of 50 to 100 kilograms, a machine direction stretch of 15 to 25 percent, and a substantially uniform density.

24 Claims, 12 Drawing Sheets

U.S. PATENT DOCUMENTS

| | | | | | |
|---|---|---|---|---|---|
| 2,705,112 | A | | 3/1955 | Baumgartner | 242/73 |
| 3,266,748 | A | | 8/1966 | Le Bus, Sr. | 242/117 |
| 3,499,641 | A | | 3/1970 | Peterson | 269/22 |
| 3,542,354 | A | | 11/1970 | Fitzpatrick | 269/22 |
| 3,545,584 | A | | 12/1970 | Takata | 192/88 |
| 3,633,352 | A | | 1/1972 | Marriner | 57/22 |
| 3,690,583 | A | | 9/1972 | Herman | 242/78.1 |
| 3,740,296 | A | | 6/1973 | McDonald | 156/504 |
| 3,743,198 | A | | 7/1973 | Lucas | 242/58.6 |
| 3,851,834 | A | | 12/1974 | White et al. | 242/68.3 |
| 4,021,002 | A | | 5/1977 | Meihofer | 242/58.1 |
| 4,079,827 | A | | 3/1978 | Work | 197/151 |
| 4,132,371 | A | | 1/1979 | Byrt | 242/58.3 |
| 4,236,449 | A | | 12/1980 | Price | 101/228 |
| 4,325,518 | A | | 4/1982 | Karr et al. | 242/68 |
| 4,466,577 | A | * | 8/1984 | Focke et al. | 242/58 |
| 4,508,291 | A | | 4/1985 | Kosch | 242/156.2 |
| 4,735,372 | A | * | 4/1988 | Seki | 242/58.1 |
| 4,767,076 | A | | 8/1988 | Tagawa | 242/58.6 |
| 4,773,609 | A | | 9/1988 | Steffen et al. | 242/68.4 |
| 4,919,353 | A | | 4/1990 | Isowa et al. | 242/58.6 |
| 4,944,470 | A | * | 7/1990 | Mobley | 242/58.4 |
| 4,969,588 | A | * | 11/1990 | Baker | 226/91 |
| 5,004,173 | A | | 4/1991 | Kawai | 242/57 |
| 5,025,998 | A | | 6/1991 | Hutzenlaub et al. | 242/55 |
| 5,174,184 | A | | 12/1992 | Meeks | 83/332 |
| 5,219,127 | A | | 6/1993 | Boldrini et al. | 242/58.4 |
| 5,289,984 | A | * | 3/1994 | Sohma | 242/58.3 |
| 5,360,502 | A | * | 11/1994 | Andersson | 156/159 |
| 5,394,779 | A | | 3/1995 | Meeks | 83/332 |
| 5,607,551 | A | | 3/1997 | Farrington, Jr. et al. | 162/109 |

FOREIGN PATENT DOCUMENTS

| | | | |
|---|---|---|---|
| EP | 0 708 074 A1 | 4/1996 | C07C/63/313 |
| FR | 2 632 294 A1 | 12/1989 | B65H/75/14 |

* cited by examiner

METHODS FOR MAKING AND PROCESSING HIGH BULK TISSUE WEBS

This application is a continuation-in-part of U.S. application Ser. No. 08/845,098 filed on Apr. 16, 1997, now U.S. Pat. No. 6,030,496.

BACKGROUND OF INVENTION

1. Technical Field

The present invention relates to methods for making and processing high bulk tissue webs. More particularly, the invention pertains to a method of making a tissue web that is wound on large diameter parent rolls, unwound for finishing operations, and subsequently rewound.

2. Background

Unwinds are used widely in the paper converting industry, particularly in the production of bathroom tissue and kitchen toweling. Manufactured parent rolls are unwound for finishing operations, such as calendering, embossing, printing, ply attachment, perforating, and then rewound into retail-sized logs or rolls. At the time a parent roll runs out in a traditional operation, the spent shaft or core must be removed from the machine, and a new roll moved into position by various means such as an overhead crane or extended level rails.

INTRODUCTION TO THE INVENTION

Historically, unwinds have made use of core plugs for support on unwind stands with the power for unwinding coming from belts on the parent roll surface. Such surface driven unwind systems are not suitable for all types of tissue webs, because they can decrease the machine direction stretch, reduce the bulk, or damage the surface of some types of tissue webs, particularly high-bulk tissue webs. In contrast, center driven unwind systems have been used mainly in film unwinding.

The down time associated with a parent roll change represents a substantial reduction in total available run time. In addition, the manpower required to change a parent roll tends to negatively impact the efficiency of a rewinder line, and possibly even the productivity of neighboring operations when workers are borrowed for roll changes. Even where a finishing unit is employed to bond the expiring web and the new web together, the webs are manually threaded and advanced resulting in significant inefficiencies. Consequently, parent roll changes according to current practices can reduce the maximum output that can be obtained from a rewinder line, and may adversely impact the productivity of neighboring operations as well.

Thus, there is a need for an improved method for making and processing a web which maintains the desirable characteristics of the web, such as the bulk and uniformity of the web. There is also a need for an improved method for making and processing a web that dramatically reduces the time the machine is actually stopped, to significantly improve overall efficiency and to maintain or improve safety for all personnel.

SUMMARY OF INVENTION

One aspect of the present invention pertains to a method of making and processing a high bulk tissue web. The method comprises the steps of: depositing an aqueous suspension of papermaking fibers onto an endless forming fabric to form a web; drying the web to form a dried web having a bulk of 9.0 cubic centimeters per gram or greater; winding the dried web to form a plurality of parent rolls each comprising a web wound on a core; transporting the parent rolls to an unwind stand comprising a pair of spaced apart arms, each arm comprising torque transmitting means for engaging a parent roll; engaging the torque transmitting means with a first parent roll; partially unwinding the first parent roll using variable speed drive means operably associated with the torque transmitting means; rotatably supporting the partially unwound first parent roll on a core placement table that is adapted to receive the partially unwound first parent roll from the arms; engaging the torque transmitting means with a second parent roll; bonding a leading end portion of the web on the second parent roll to a trailing end portion of the partially unwound first parent roll to form a joined web; and rewinding the joined web.

In another embodiment, a method of making and processing a high bulk, uncreped throughdried tissue web comprises the steps of: depositing an aqueous suspension of papermaking fibers onto an endless forming fabric to form a web; transferring the web to a throughdrying fabric; throughdrying the web to form an uncreped throughdried web having a bulk of 6.0 cubic centimeters per gram or greater; winding the dried web to form a plurality of parent rolls each comprising an uncreped throughdried web wound on a core; transporting the parent rolls to an unwind stand comprising a pair of spaced apart arms, each arm comprising torque transmitting means for engaging a parent roll; engaging the torque transmitting means with a first parent roll; partially unwinding the first parent roll using variable speed drive means operably associated with the torque transmitting means; rotatably supporting the partially unwound first parent roll on a core placement table that is adapted to receive the partially unwound first parent roll from the arms; engaging the torque transmitting means with a second parent roll; bonding a leading end portion of the web on the second parent roll to a trailing end portion of the partially unwound first parent roll to form a joined web; and rewinding the joined web.

The unwind stand may include a frame with pivotally mounted arms. The arms desirably move the first parent roll to an unwind position for partially unwinding the first parent roll; then move the first parent roll to a position in close proximity to or contact with the core placement table; and then move the second parent roll to an unwind position for partially unwinding the second parent roll core. When the webs from the first and second parent rolls are being spliced together, the variable speed drive means and a core placement drive motor simultaneously unwind the first and second parent rolls.

The webs of the parent rolls are desirably united using a thread-up conveyor. The leading end portion of the web on the second parent roll is transported by the thread-up conveyor, which preferably comprises a vacuum means operably associated with an endless screen belt means. In one embodiment, the leading end portion of the web on the second parent roll is transported over the endless screen belt means with decreasing amounts of vacuum. Once the leading end portion of the web on the second parent roll is disposed on the trailing end portion of the web on the partially unwound first parent roll, the thread-up conveyor and unwinding of the second parent roll are operated at a same surface speed.

Advantageously, the thread-up conveyor may be moved, and in particular pivoted, relative to the second parent roll between an active position and a standby position. In the active position, the thread-up conveyor is in close proximity to or in contact with the second parent roll, whereas in the standby position the thread-up conveyor is positioned away from the parent roll.

The core placement table is desirably moveable in a direction transverse to the path of travel of the web between an inline position and a standby position. The inline position corresponds to the web centerline to enable partially unwound parent rolls to be placed on the core placement table, whereas in the standby position the core placement table is positioned away from the unwinding operation for ease of operator access.

Suitable soft, high bulk tissues for purposes of this invention include tissue sheets as described in U.S. Pat. No. 5,607,551 issued Mar. 4, 1997 to Farrington, Jr. et al. entitled "Soft Tissue", which is herein incorporated by reference. The method is particularly useful for soft, high bulk uncreped throughdried tissue sheets. Such tissues suitably have bulk values of 6.0 cubic centimeters per gram or greater (before calendering), desirably about 9 cubic centimeters per gram or greater, more specifically from about 10 to about 35 cubic centimeters per gram, and still more specifically from about 15 to about 25 cubic centimeters per gram. The method for measuring bulk is described in the Farrington, Jr. et al. patent. In addition, the soft, high bulk tissues of this invention can be characterized by a relatively low stiffness as determined by the MD Max Slope and/or the MD Stiffness Factor, the measurement of which is also described in the Farrington, Jr. et al. patent. More specifically, the MD Max Slope, expressed as kilograms per 3 inches of sample, can be about 10 or less, more specifically about 5 or less, and still more specifically from about 3 to about 6. The MD Stiffness Factor for tissue sheets of this invention, expressed as (kilograms per 3 inches)-microns$^{0.5}$, can be about 150 or less, more specifically about 100 or less, and still more specifically from about 50 to about 100. Furthermore, the soft, high bulk tissues of this invention can have a machine direction stretch of about 10 percent or greater, more specifically from about 10 to about 30 percent, and still more specifically from about 15 to about 25 percent. In addition, the soft, high bulk tissue sheets of this invention suitably have a substantially uniform density since they are preferably throughdried to final dryness without any significant differential compression.

Parent roll cores used in the present method preferably have an outside diameter of at least about 14 inches, and more particularly about 20 inches. The parent rolls have a face or circumferential surface, an inner core surface, and opposite end surfaces. The outside diameters of such rolls can be at least about 60 inches, and in particular about 120 inches or greater, such as about 140 inches or greater. The widths of the parent rolls, measured between the opposite end surfaces, are generally at least about 55 inches, more particularly at least about 100 inches, such as about 105 inches or greater. Consequently, the weights of the rolls may be about 2000 lbs. or more, particularly about 3000 lbs. or more, and more particularly about 4000 lbs. or more.

In particular embodiments, a center driven unwind system is employed to eliminate or reduce the following detrimental effects on the web: 1. surface damage (scuffing, tearing, etc.); 2. wrinkling of the web; 3. de-bulking; and 4. stretch loss. All of these detrimental effects are typical of a surface driven unwind on a low-density basesheet, such as an uncreped through-air-dried basesheet. These effects negatively impact the off-line finishing processes and/or the finished product. A large factor in creating these defects is the differential effects across the circumferential surface of a parent roll due to the limited contact area with the surface driven unwind belts. Specifically the possible defects are: 1. surface damage which introduces defects or tears that affect product performance and/or process runability; 2. wrinkling which impacts processes such as calendering, embossing, printing, ply-bonding, perforating and rewinding, thereby affecting finished product appearance, performance and process runability; 3. de-bulking which results in a denser web which affects product performance and preference; and 4. stretch loss which affects product performance and/or process runability.

The center driven unwind is used to preserve web attributes, such as high bulk and stretch, during the unwinding process. The web is also treated consistently across the circumferential surface of the parent roll. Other system components, such as draw control, are used to further protect the web. As an alternative to the center driven unwind, or in combination therewith, other suitable torque transmitting means may be employed to unwind the parent rolls. For example, the torque transmitting means may comprise side clamping mechanisms such as one or more inflatable bladders that engage the opposite end surfaces of the parent rolls.

The addition of a torque transmitting means that engage the opposite end surfaces of the parent rolls provides a further means of transferring torque to the roll for unwinding. This supplemental torque transfer may be desirable for relatively high bulk sheets, because the wound in tension in the roll may be reduced in order to protect the web properties. Lower wound in tension, though, adversely impacts the ability to drive the roll from the core. In high bulk sheets, using a center-driven unwind system alone creates the potential for slippage or shifting between the individual layers of the roll as well as between the initial sheet layers and the core, particularly during periods of high acceleration or deceleration. Rapid speed changes combined with a large mass moment of inertia produces high torque requirements resulting in very large circumferential forces, especially in areas near the core. The combination of large forces and lower interlayer pressures increases the likelihood of shifting between sheet layers, which leads to problems in the unwinding sequence such as web velocity or tension variability, telescoping of the parent roll and/or severe wrinkling of the web.

In one embodiment, the supplemental torque transfer means transmits torque from the unwind shaft through the roll via the one or more inflatable bladders that are in pressure contact with the opposite end surfaces of the parent roll. The bladders can be supported by a backing plate that is operatively attached to the unwind shaft. The bladders can be deflated and thus disengaged as the parent roll is unwound to smaller diameters to eliminate disturbances with the web as it is peeled away from the roll. The bladders are suitably formed of an air or fluid impermeable material that is conformable to the end surfaces of the parent rolls, for example rubber, polyurethane, other synthetic polymers, or the like. Particularly suitable materials may have a coefficient of friction of about 0.3 or greater, and particularly about 0.5 or greater.

Hence, another aspect of the present invention concerns a torque transfer device for unwinding a tissue roll that has a circumferential surface, opposite end surfaces, an inner core surface, an outside diameter of at least about 60 inches, and a width between the opposite end surfaces of at least about 55 inches. The torque transfer device includes a frame comprising a pair of arms that are spaced apart to accommodate the width of the roll therebetween. Each arm comprises a side clamping mechanism mounted thereon and adapted to engage one of the opposite end surfaces of the tissue roll. The side clamping mechanisms comprise a backing plate operably connected to and rotatable with an unwind shaft that is connected to an electric drive means. The side clamping mechanisms also comprise an inflatable bladder mounted on the backing plate and means for inflating the bladder such that the opposite end surfaces of the roll are sandwiched between the side clamping mechanisms.

The advantages attributable to the supplemental torque transfer means compared to traditional unwind assist devices, such as surface belts and rider rolls, include: low engagement pressures may be used due to the large available contact area; the circumferential surface of the roll is not damaged; torque is transmitted directly to a significant portion of the roll versus through the core and/or the circumferential surface of the roll; and operators can observe the complete circumferential surface of the roll.

Another aspect of the invention pertains to a method for making a web with dramatically less down time needed to splice parent roll webs. The method utilizes a finishing operation that substantially continuously impacts the web in order to splice the webs together. For purposes of the present invention, finishing operations that substantially continuously impact the web include embossing, crimping, and even calendering. These finishing operations desirably impact the web over the full width of the web so that a full-width splice is produced between the webs for improved strength. The term "substantially continuously impact" is used herein to refer to processes that structurally modify the surface characteristics of the web, either continuously as in calendering or substantially continuously as in embossing or crimping, and that form a joined web for rewinding purposes when two webs from different parent rolls are processed simultaneously. This is in contrast to separate bonding units that are only intermittently operated to form a splice between webs from different rolls. This is also in contrast to methods that inject bonding agents, such as glue, tape, or the like, in order to splice the webs together.

Hence, one embodiment of the invention concerns a method of splicing tissue webs without glue or tape, comprising the steps of: partially unwinding a first tissue web from a first parent roll using drive motor means; transporting the first tissue web to a finishing unit comprising rolls defining a finishing unit nip; substantially continuously impacting solely the first tissue web in the finishing unit nip while the first tissue web is unwound from the first parent roll using drive motor means; partially unwinding a second tissue web from a second parent roll; transporting the second tissue web to the finishing unit using drive motor means; maintaining the first and second tissue webs moveable relative to one another upstream of the finishing unit; simultaneously unwinding both the first and second tissue webs from the first and second parent rolls using drive motor means and passing the webs jointly through the finishing unit nip to bond the webs together; and substantially continuously impacting solely the second tissue web in the finishing unit nip while the second tissue web is unwound from the second parent roll using drive motor means.

Thus, the webs from the expiring roll and the new roll are both driven through the first process nip, and are not bonded together until the first process nip. Utilizing the first finishing operation after the unwind to splice different parent roll webs together eliminates the need for separate bonding units and eliminates the need for external bonding means such as glue, tape, or the like. The present method replaces existing manual methods such as threading each new web or tying webs together.

The tissue product of this invention can be one-ply, two-ply, three-ply or more. The individual plies can be layered or non-layered (homogeneous) and uncreped and throughdried. For purposes herein, "tissue sheet" is a single ply sheet suitable for facial tissue, bath tissue, towels, napkins, or the like having a density of from about 0.04 grams per cubic centimeter to about 0.3 grams per cubic centimeter and a basis weight of from about 4 to about 40 pounds per 2880 square feet. Tensile strengths in the machine direction are in the range of from about 100 to about 5,000 grams per inch of width. Tensile strengths in the cross-machine direction are in the range of from about 50 to about 2500 grams per inch of width. Cellulosic tissue sheets of paper-making fibers are preferred, although synthetic fibers can be present in significant amounts.

BRIEF DESCRIPTION OF THE DRAWINGS

The invention is described in conjunction with the accompanying drawings.

DETAILED DESCRIPTION

Figure 15:
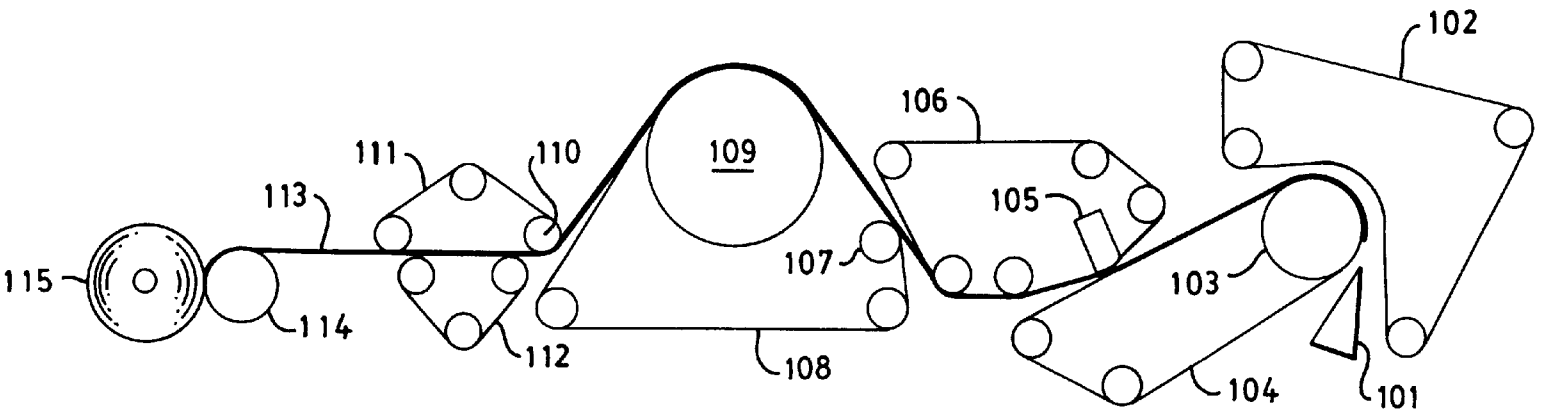
FIG. 15 is a partial schematic process flow diagram for a method of making a tissue web, and in particular an uncreped tissue web.

Referring first to FIG. 15, a method of carrying out this invention will be described in greater detail. FIG. 15 describes a process for making a tissue web, and particularly an uncreped throughdried base sheet. Shown is a twin wire former having a layered papermaking headbox 101 which injects or deposits a stream of an aqueous suspension of papermaking fibers onto a forming fabric 102. The resulting web is then transferred to a fabric 104 traveling about a forming roll 103. The fabric 104 serves to support and carry the newly-formed wet web downstream in the process as the web is partially dewatered to a consistency of about 10 dry weight percent. Additional dewatering of the wet web can be carried out, such as by differential air pressure, while the wet web is supported by the forming fabric.

The wet web is then transferred from the fabric 104 to a transfer fabric 106 traveling at a slower speed than the forming fabric in order to impart increased MD stretch into the web. A kiss transfer is carried out to avoid compression of the wet web, preferably with the assistance of a vacuum shoe 105. The web is then transferred from the transfer fabric to a throughdrying fabric 108 with the aid of a vacuum transfer roll 107 or a vacuum transfer shoe. The throughdrying fabric can be traveling at about the same speed or a different speed relative to the transfer fabric. If desired, the throughdrying fabric can be run at a slower speed to further enhance MD stretch. Transfer is preferably carried out with vacuum assistance to ensure deformation of the sheet to conform to the throughdrying fabric, thus yielding desired bulk, flexibility, CD stretch and appearance.

The level of vacuum used for the web transfers can be from about 3 to about 15 inches of mercury (75 to about 380 millimeters of mercury), preferably about 10 inches (254 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is final dried to a consistency of about 94 percent or greater by a throughdryer 109 and thereafter transferred to an upper carrier fabric 111 traveling about roll 110.

The resulting dried basesheet 113 is transported between upper and lower transfer fabrics, 111 and 112 respectively, to a reel 114 where it is wound into a parent roll 115 for subsequent unwinding, possible converting operations, and rewinding as described below. For the tissue making portion of this invention, the forming process and tackle can be conventional as is well known in the papermaking industry. Such formation processes include Fourdrinier, roof formers such as a suction breast roll, gap formers such as twin wire formers and crescent formers, and other suitable formers. A twin wire former may be preferred for higher speed operation. Forming wires or fabrics can also be conventional, the finer weaves providing greater fiber support and a smoother sheet and the coarser weaves providing greater bulk. Headboxes used to deposit the fibers onto the forming fabric can be layered or nonlayered, although layered headboxes are advantageous because the properties of the tissue can be finely tuned by altering the composition of the various layers. The throughdryers and throughdrying fabrics can also be of a conventional nature.

Figure 1:
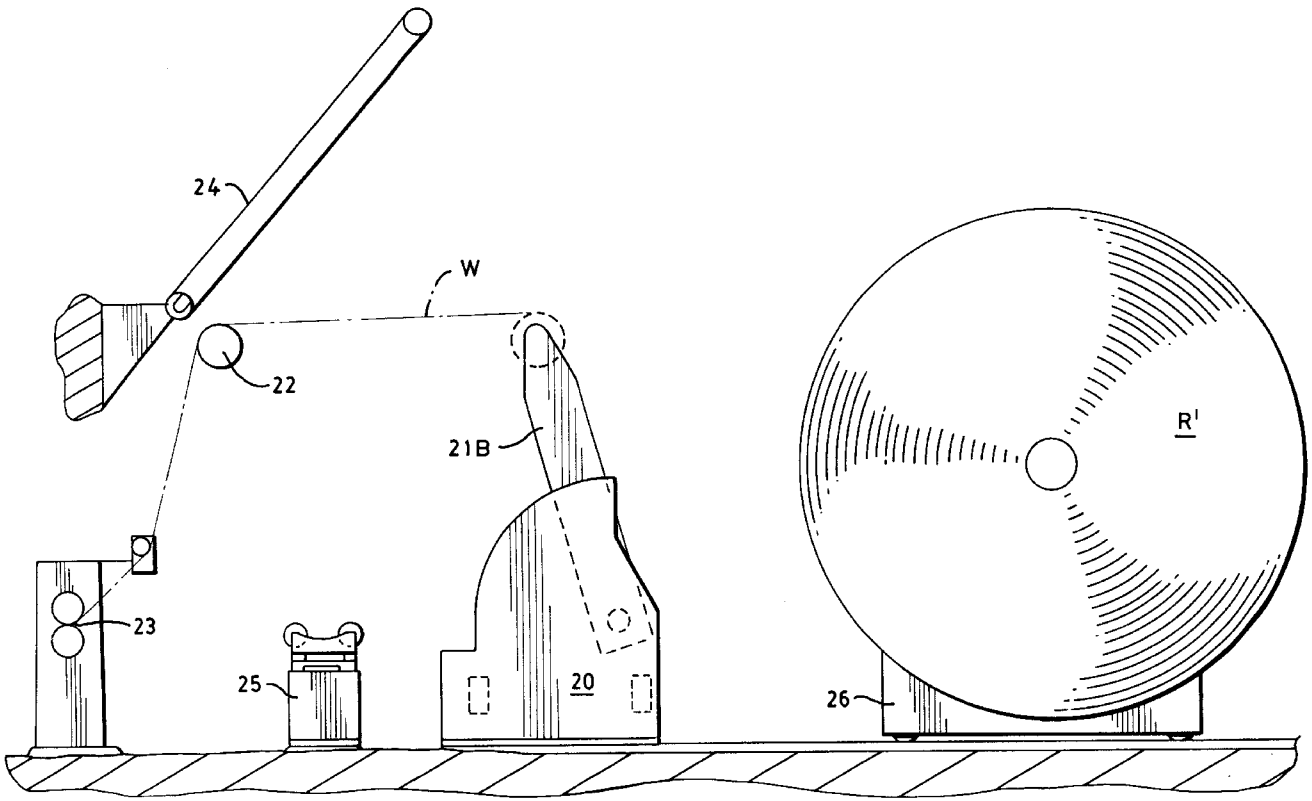
FIG. 1 is a schematic side elevational view of an unwind system near the end of an unwind cycle.
Figure 2:
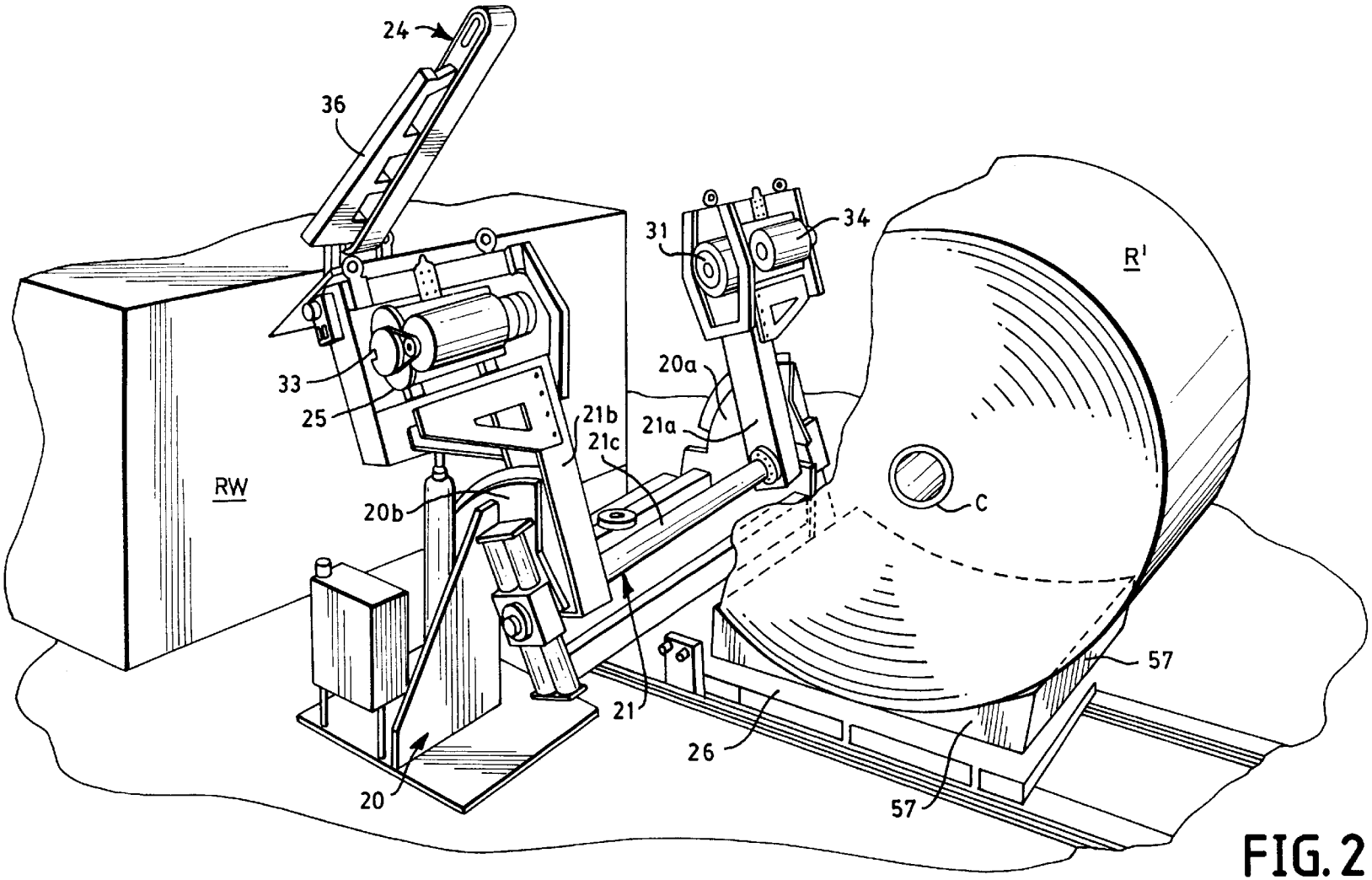
FIG. 2 is a perspective side elevational view of the unwind system of FIG. 1 as seen from the upstream drive side, i.e., the side opposite the operator side, wherein upstream refers to the start of the path or stream of the web and downstream refers to the direction of the rewinder.
Figure 3:
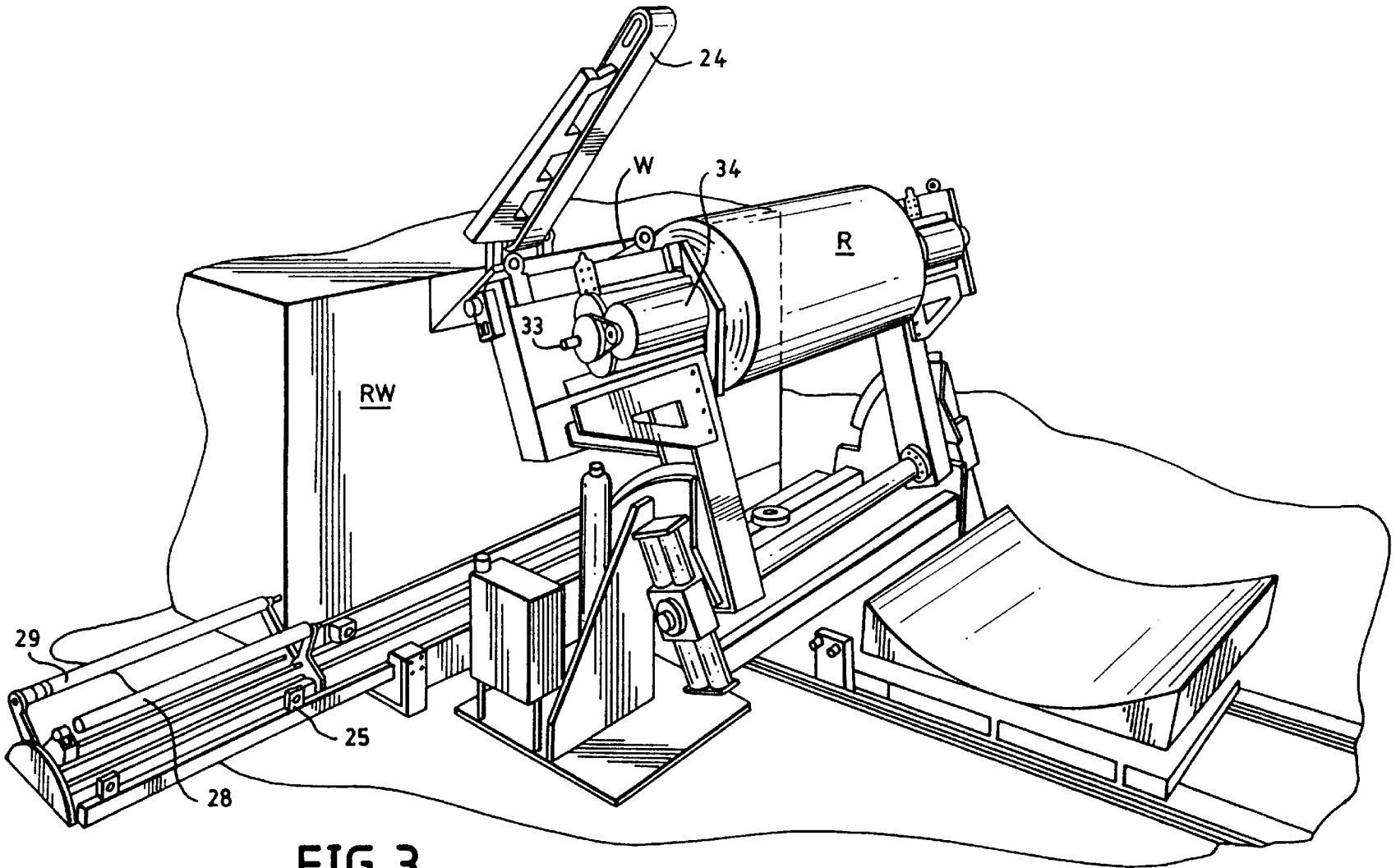
FIG. 3 is another perspective view of the unwind system but slightly more downstream than FIG. 2 and showing the unwind in the middle of an unwind cycle.
Figure 4:
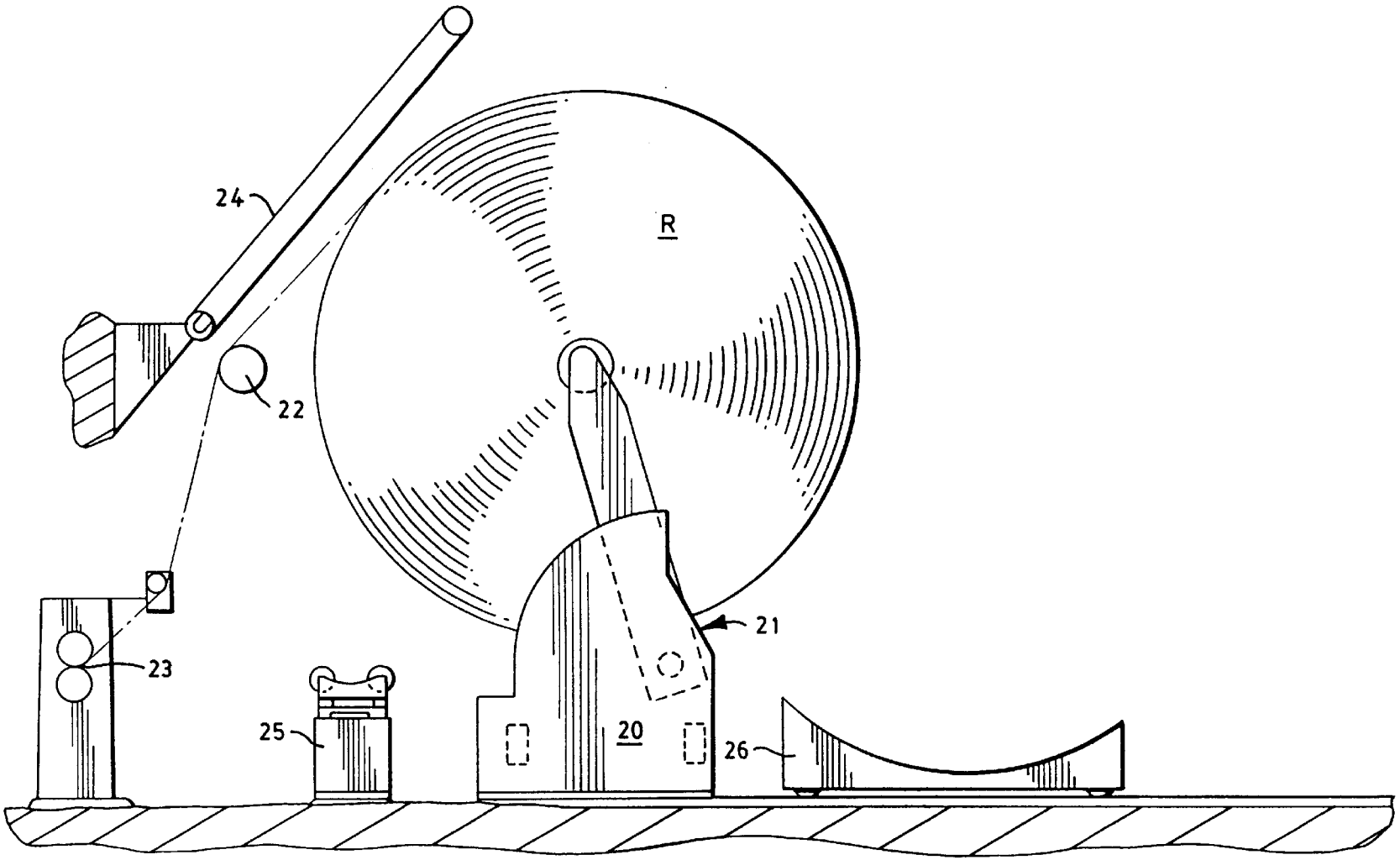
FIG. 4 is a schematic side elevational view corresponding to the perspective view of FIG. 3 but showing a full roll at the start of the unwinding cycle.
Figure 5:
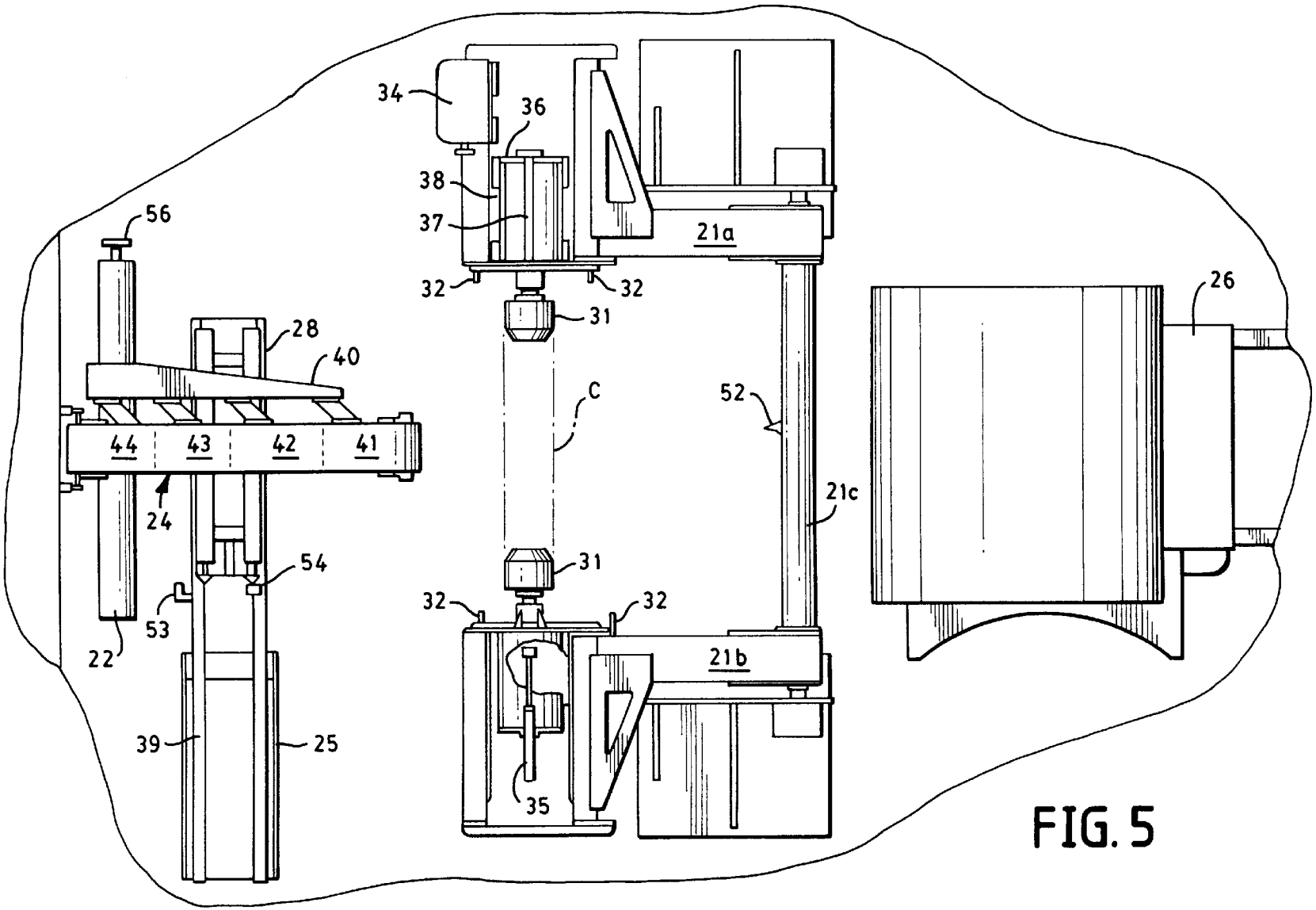
FIG. 5 is a top plan view of the unwind system as seen in the preceding views but with a portion broken away to reveal an otherwise hidden cylinder.

In the central part of FIGS. 1 and 2, the numeral 20 designates generally a frame for the unwind stand which includes a pair of side frames as at 20*a* and 20*b*, the latter being seen in the central portion of FIG. 2. The frame 20 pivotally supports arm means generally designated 21 which is seen to be essentially U-shaped. The arm on the operating side is designated 21*a* while the arm on the drive side is designated 21*b*. Interconnecting and rigidifying the two arms is a transverse member 21*c*. The arms are seen to support a parent roll R which, as can be quickly appreciated from a consideration of FIGS. 3 and 4, is in the process of being unwound to provide a web W. The web W proceeds over a roller 22 (designated in the center left of FIGS. 1 and 4) and into a bonding unit generally designated 23. These elements of the system are also seen in FIG. 5. The roller 22 may be an idler or driven.

Other elements depicted in FIGS. 1–4 are a thread-up conveyor generally designated 24, a core placement table generally designated 25 and a means 26 such as a cart for supporting a parent roll R' subsequently to be unwound (see FIGS. 1 and 2). In FIG. 2, the core C is clearly seen. Also, at the extreme left in FIGS. 2 and 3, a rewinder RW is seen to be at the downstream end of the system.

It is believed that various aspects of the invention can be appreciated most quickly from an understanding of the sequence of operation which is depicted in FIGS. 1 and 6–11.

Figure 14:
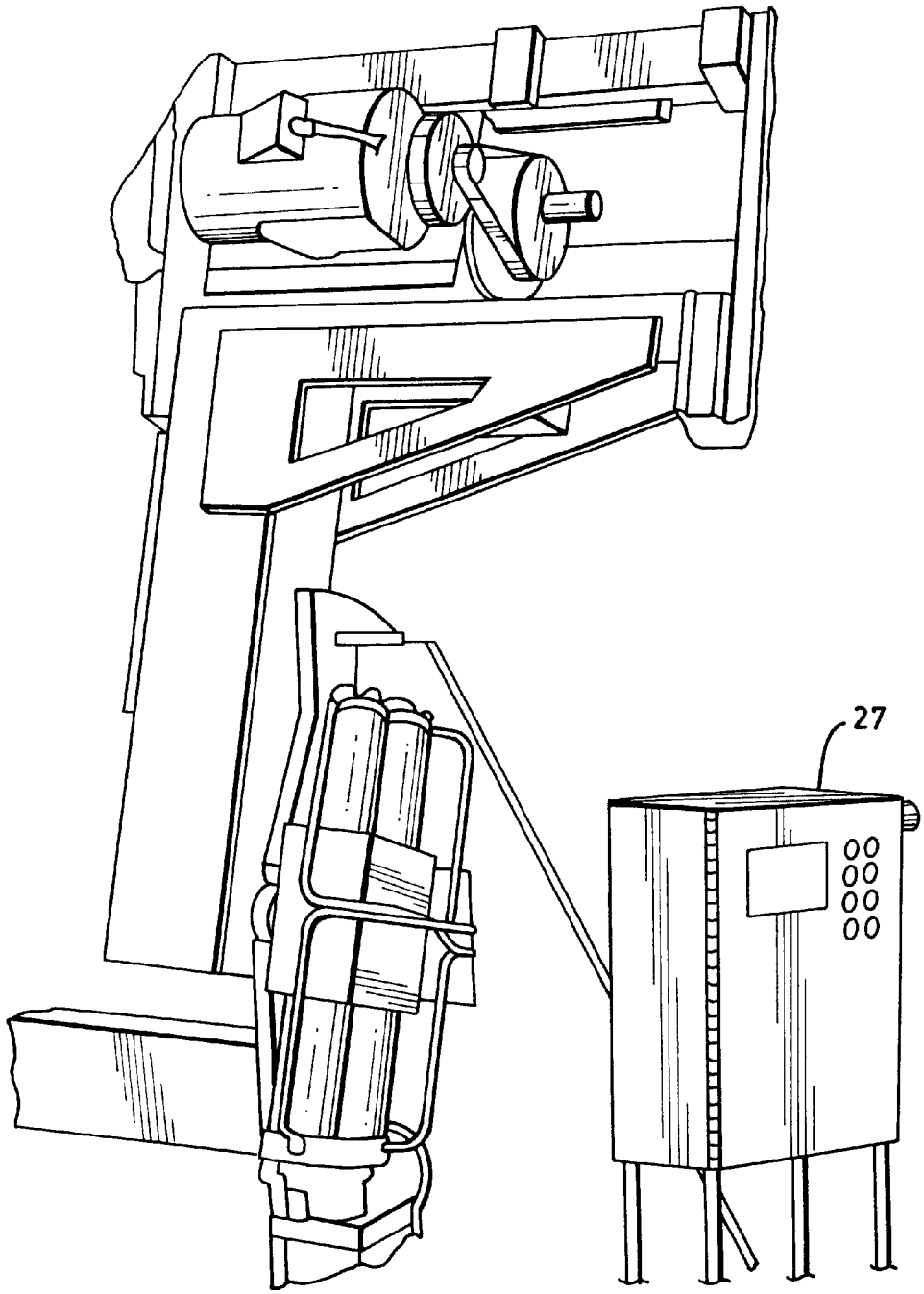
FIG. 14 is a fragmentary perspective view from the operator side of the unwind system and featuring the control means.

With the machine running and the diameter of the parent roll R decreasing, a deceleration diameter is calculated by a control means generally designated 27. In FIG. 2, this is partially obscured by the side frame 20*a* but can be seen clearly in FIG. 14.

When the parent roll diameter reaches this determined diameter, the unwind and associated equipment begin decelerating. During this time the core placement table 25 is aligned with the web center line of FIG. 2, having previously been in the standby position of FIG. 3.

When all machine sections reach zero or a reduced speed and the core table 25 is confirmed empty, the core placement position of the arm means 21 is calculated which will set the expired parent roll $R_x$ slightly above or lightly on the cradle rollers 28, 29 of the core table 25. Advantageously, one of the cradle rollers 28 is driven, while the other is an idler.

Figure 6:
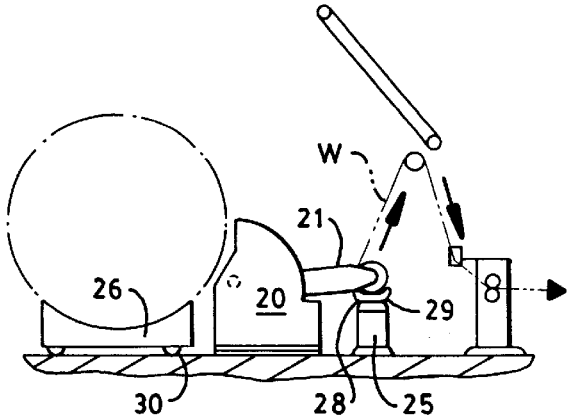
FIG. 6 is a schematic side elevational view similar to FIG. 1 but from the operator side and also showing the condition of the apparatus as a parent roll is almost completely unwound, i.e., slightly later in the operational sequence than FIG. 1.
Figure 7:
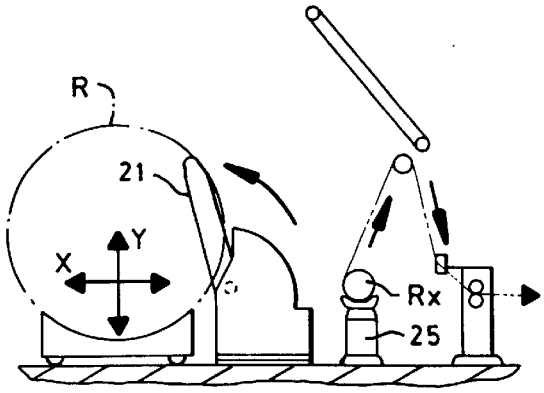
FIG. 7 is another sequence view now showing the beginning of the provision of a new parent roll.

The arm means 21 is now pivoted toward this calculated position, as shown in FIG. 6. As the arm means moves under the signal from the control means 27, the web W can be unwound in order to prevent web breakage. During this period the parent roll cart 26 (see FIG. 6) is moved into the unwind loading position.

The cart movement is based on previous roll diameter, measured diameter or an assumed diameter. The previous roll diameter is that of the last parent roll when loaded. So the assumption is that the new parent roll has the same diameter and so the position of the "old" roll is the one selected for the "new" roll. The "measured" diameter can be that as actually measured, either mechanically or manually. The "assumed" diameter is a constant value selected by the operator which is used repeatedly as coming near the actual diameter. In any event, this pre-positions the cart to minimize subsequent moves which, if needed, could frustrate the achievement of a one-minute or less roll change. The cart movement is under the control of the control means 27. The object of the inventive unwind is to have its operation as automatic as possible, for both safety and efficiency.

The cart 26 may move into the position shown in the unwind along either the machine directional axis or the cross directional axis. However, the cart 26 is shown moving along the machine direction (see the wheels 30) in FIGS. 6–13 for conceptual clarity.

When the arm means 21 reaches the core drop position relative to the core table 25 as shown in FIG. 6, the core chucks 31 (see FIG. 5) are contracted by control means 27 which allows both of the core chucks 31 (see particularly FIG. 2) to be fully retracted out of the core C (compare FIGS. 6 and 7), and the expired parent roll $R_x$ placed onto the core table 25. Advantageously, the control means 27 is a Model PIC 900 available from Giddings and Lewis, located in Fond du Lac, Wis.

As the arm means 21 moves toward this new position, photoelectric sensors 32 (see FIG. 5) which are mounted on the arm means 21, detect the edge of the parent roll loaded into the parent roll cart. When each sensor detects a parent roll edge, the angular position of the arm means 21 is recorded by the control means 27. Each data point along with known geometries and cart X-Y coordinates (see the designated arrows in FIG. 7) is used to calculate parent roll diameter and estimate X-Y coordinates of the center of the core C. Based on the core coordinates, the parent roll cart 26 is repositioned.

With the parent roll R repositioned and arm means 21 moving toward the parent roll loading position, the sensors 32 mounted on the arm means 21 (see FIG. 5) will detect the leading and trailing edge of the core. As each sensor 32 detects an edge, the angular position of the associated pivot arm is recorded in the control means 27.

This data, along with known geometries, is used to calculate multiple X-Y coordinates of the center of the core. Coordinates are calculated separately for each end of the core. Averaging is used to obtain a best estimate of core coordinates for each end of the core.

The parent roll cart 26 is again repositioned to align the center of the core C and core chucks 31. If the cross directional axis of the core is properly aligned with the cross directional axis of the cart 26, both the core chucks 31 are extended into the core C and the chucks are expanded to contact the core. The expansion and contraction of the chuck means 31 is achieved by internal air operated bladders or other actuating means under signal from the control means 27. Air is delivered through a rotary union 33, shown in the central portion of FIG. 3.

Figure 8:
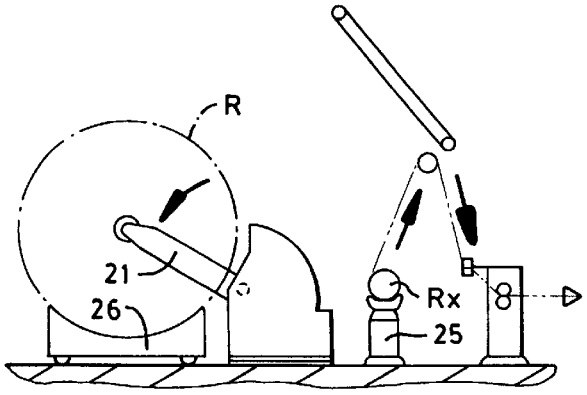
FIG. 8 is a view of the apparatus in its condition slightly later than that shown in FIG. 7.

FIG. 8 shows the arm means 21 in the loading position. If core skewing is excessive, the alignment of the parent roll core and core chucks must be individually performed on each end of the core. First, the arm means 21 and possibly the parent roll cart 26 are positioned so that one chuck 31 can be extended into the core C. Once in the core, the first chuck is expanded. Next, the parent roll cart 26 and/or arm means 21 is repositioned to align the remaining core chuck 31 with the core C. Once aligned, the second core chuck 31 is extended and expanded.

When fully chucked, regardless of the chucking process, the parent roll R is lifted slightly out of the cart 26. Then, the parent roll is driven, i.e., rotatably, by motors 34 (FIGS. 2 and 5) which drive the chucks 31. Using motors on each arm evenly distributes the energy required. However, advantageous results can be obtained with motorizing only one of the chucks. Sufficient torque is applied by the core chuck drive motors 34 to test for slippage between a core chuck 31 and the core C. If slippage is detected, the parent roll is lowered back into the cart 26. The core chucks are contracted, removed from the core, and repositioned (i.e., "loaded") into the core. The core slippage test is then repeated. Multiple failures of this test can result in an operator fault being issued.

Figure 9:
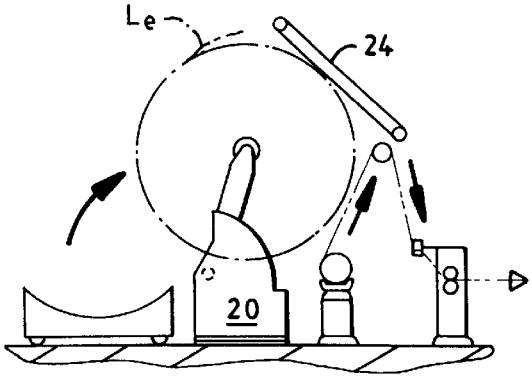
FIG. 9 is a view like the preceding views except that now a fully wound parent roll is installed in the unwind.

If no slippage is detected, arm means 21 is moved to the winding position, i.e., generally upright. As shown by FIG. 9, with the arm means in the run position, the vacuum thread up conveyor 24 is lowered into close proximity to or contact with the parent roll and the vacuum is activated. The core chuck drive motors 34 rotate the parent roll R. The thread-up conveyor 24 operates at the same surface speed as the parent roll surface speed.

Figure 10:
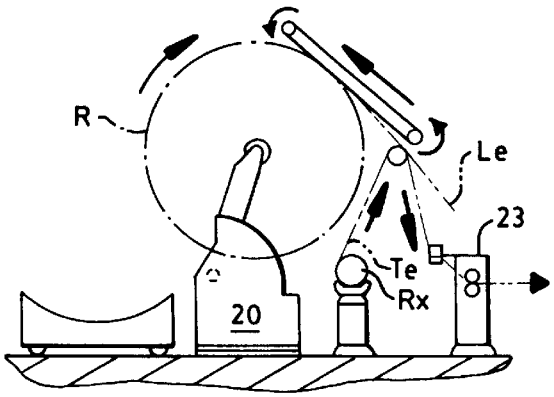
FIG. 10 is a view of the apparatus in a condition for coupling the leading edge portion of the new parent roll to the trailing tail portion of the almost expended parent roll.
Figure 11:
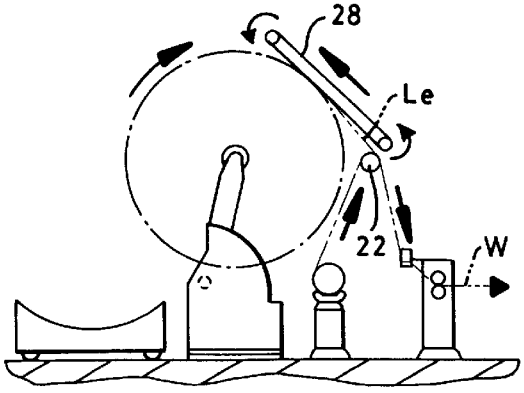
FIG. 11 is a view similar to FIG. 10 but now showing the two webs in the process of being bonded together.

Now referring to FIG. 10, when the leading end $L_e$ of the web on the parent roll R comes into contact with the vacuum conveyor 24, the tail is sucked up and pulled along by the vacuum thread up conveyor.

When the discharge end of the vacuum thread-up conveyor 24 is reached, the new web end portion $L_e$ drops onto the trailing end portion $T_e$ of the web from the expired parent roll $R_x$, depicted by FIG. 10. The rest of the machine line including the driven roller 28 is now brought up to match speed with that of the unwind.

The new web is carried through the line with the web from the expired roll. The two webs can then be bonded together as at W in FIG. 11. An embossing-type method as at 23 is shown, but any method of web bonding could be used. After combining the webs, the web from the expired parent roll is no longer needed and brake means associated with the core table or roller 28 stops the expiring parent roll from turning and thus breaks the expired web. When appropriate, vacuum is removed and the vacuum thread-up conveyor is raised. The unwind now returns to previous running speeds. As the machine accelerates, the parent roll cart 26 is returned to its loading position for another roll and the core table is retracted to allow for core removal.

The control means 27 performs a number of functions. First, in combination with the parent roll cart means 26, it calculates diameter and determines the position of the core C for positioning the cart means for insertion of the chuck means 31 into the parent roll core. Further, the control means 27 includes means cooperating with the sensor means 32 for calculating the coordinates of the parent roll core and averaging the coordinates prior to insertion of the chuck means 31. Still further, the control means includes further means for comparing the alignment of the core cross-directional axis with the parent roll cross-directional axis.

When all is aligned, the control means 27 operate the chuck means 31 for insertion into the core C by actuation of the cylinders 35 (see FIGS. 2 and 5). The control means 27 further causes expansion of the chuck means 31 in order to internally clamp the tubular core C. Relative to the insertion of the chuck means 31, the drive shaft of each motor 34 is offset from the axis of the associated chuck means 31 as can be seen in the left central part of FIG. 2 and the upper part of FIG. 5. There, the motor 34 is connected by a drive 36 to the shaft 37 of the chuck means 31. The shaft 37 is rotatably supported in the housing 38 of the chuck means 31. From the upper part of FIG. 5, it will be seen that the motor 34 is offset from the shaft 37 and from the lower part of FIG. 5 it will be seen that the cylinder 35 is responsible for moving the housing 38 and therefore the chuck means 31 into engagement with the core C.

During normal operation, the control means also calculates the deceleration diameter of the roll R being unwound, confirms the emptiness of the core table 25 and operates the arm means 21.

Reference to FIG. 5 reveals that the core placement table 25 is mounted in rails 39 for advantageous removal during the unwind cycle. So if a web break occurs, the table is out of the web path so as not to interfere with clean-up. Also in FIG. 5 the thread-up conveyor 24 is seen to include a vacuum manifold 40 which provides a plurality of vacuum stages as at 41, 42, 43 and 44 of gradually less vacuum. The conveyor 24 is advantageously of screen or mesh construction to facilitate pickup of the leading edge portion of the web from the "new" parent roll.

Such a leading end portion may be folded to provide triangular shape to facilitate taping down. This helps prevent inadvertent detachment of the leading edge portion from the underlying ply during transfer of the parent roll from the paper machine to the site of rewinding. Normally, the first log rewound from a new parent roll is discarded so this eliminates the concern over a lumpy transfer.

As part of the program of operation of the unwind under the control of the control means 27, the conveyor 24 and vacuum from a pump (not shown) are both shut down to conserve energy and avoid unnecessary noise.

Figure 12:
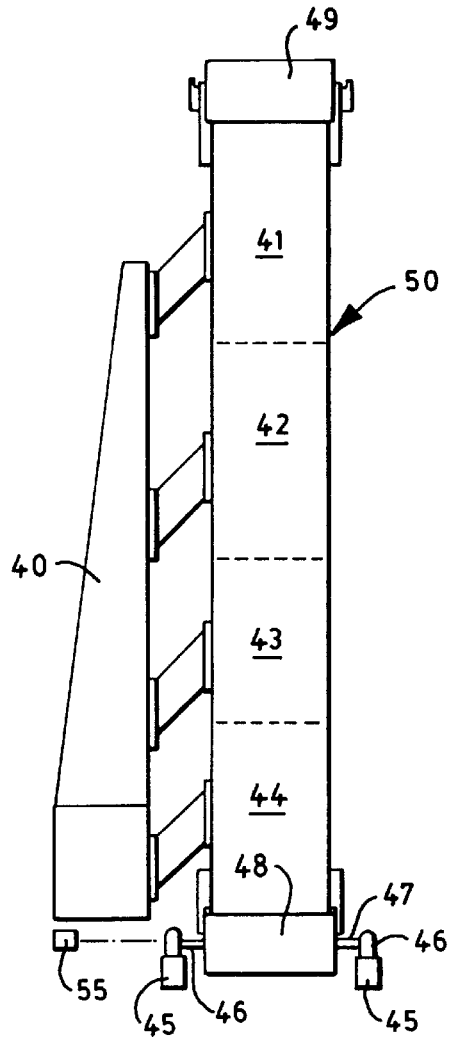
FIG. 12 is a top plan view of the thread-up conveyor.
Figure 13:
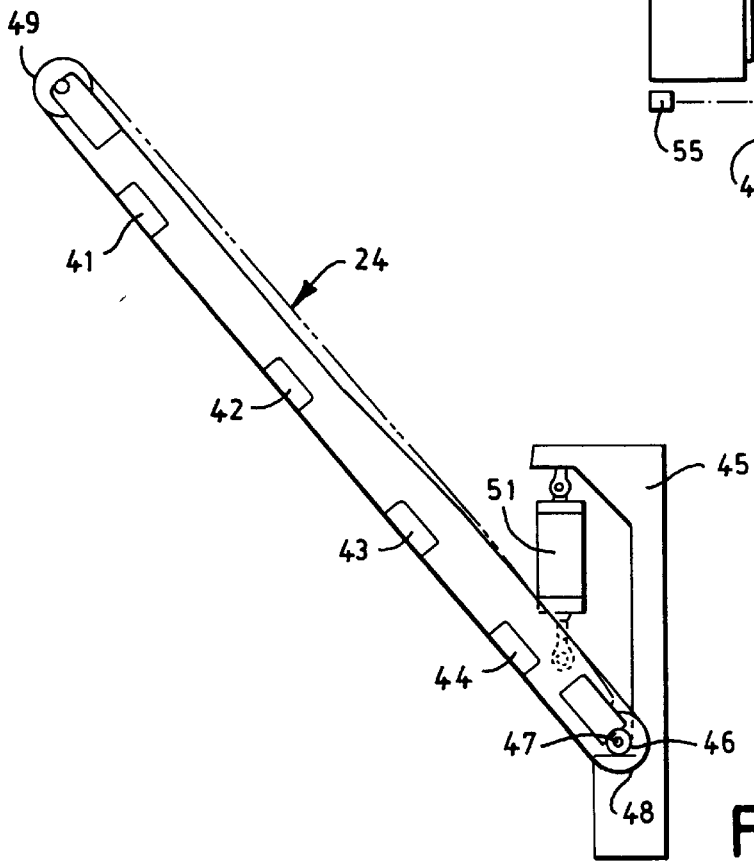
FIG. 13 is a side elevational view of the conveyor of FIG. 12.

The thread-up conveyor 24 is pivotally supported on a pair of pedestals 45 (see the right lower portion of FIG. 13) which provides a mounting 46 for each side of the conveyor 24 (see FIG. 12). The mountings 46 rotatably carry a cross shaft 47 which is on the axis of the lower (driving) roller 48. At its upper end, the conveyor has an idler roller 49 supported on the staged chamber generally designated 50 which is coupled to the manifold 40.

Positioning of the conveyor 24 via changing its angle is achieved by a pair of pressure cylinders 51 coupled between the pedestals 45 and the chamber 50. The cylinders 51 are also under the control of the control means 27.

To enable the control means 27 to calculate the deceleration diameter near the end of the unwind cycle, a further sensor 52 is provided on the transverse member 21*c* of arm means 21, as seen in FIG. 5. In addition, the sensor continually reports the radius of the parent roll and the control means continually calculates the motor speed to obtain a desired unwind. Alternatively, process feedback such as load cells or dancers can be used to report to the control means changes in tension or the like and enable the control means to vary the motor speed.

Once the rewinder is located, which is a primary consideration because of its involvement with the core hopper, core feed, log removal and log saw, the unwind frame 20 is placed a suitable distance upstream to accommodate the core placement table 25, the thread-up conveyor 24 and any bonding unit 23.

The location of the core placement table 25 is a function of the pivot geometry of the arm means 21 as can be appreciated from a consideration of FIG. 6. On the other hand, the location of the thread-up conveyor 24 is not only a function of the arm means geometry but also the size parent rolls to be unwound.

In a similar fashion to the location of the core table 25, the cart 26 must be placeable to have the parent roll engageable by the chucks 31 of the arm means 21.

The unwind system, although having a means for actually rotating the parent roll, really includes a path or section of a mill's converting area extending from the cart means 26 which provides the next parent roll, all the way to the rewinder proper.

The unwind system includes many significant structural features which are discussed below. For example, unwind system employs the roll cart means 26 operably associated with the frame 20 for supporting a "new" parent roll R', the roll cart means 26 cooperating with the control means 27 for positioning the chuck means 31 and inserting the same into a parent roll core C.

Further, the control means 27 includes sensor means 32 cooperatively coupled together for calculating the coordinates of the "new" parent roll R' and averaging the coordinates prior to insertion of the chuck means 31.

Still further, the control means 27 includes the capability to compare the alignment of the core cross directional with the parent roll cross directional axis. The control means capability also includes the controlling of the insertion of the chuck means 31 into the core C by, for example, controlling the operation of the fluid pressure cylinders 35.

Near the end of the unwinding cycle, the control means 27 regulate the pivotal movement of the arm means 21 as a function of the degree of unwinding of the parent roll R. Also during the unwinding cycle (during its last stages generally), the control means 27 in combination with sensing means 53 determines the condition of the core placement table 25 (see the left center portion of FIG. 5).

Near the very end of the unwinding cycle it is important for the core placement table to be in position to receive the almost-expired roll Rx, be free of any obstructing material and also have its rotating roller 28 in operation. But at the very end, motor and brake means 54 operably associated with the roller 28 are energized to snap off the web W, with a minimum of web tail retained on the table 25—optimally about ¼" (6 mm).

Prior to the time referred to immediately above, but again toward the end of an unwinding cycle, the control means actuates the thread-up conveyor 24 via a drive 55 (see the lower left of FIG. 12). The drive 55 is coupled to the drive 56 of the driven roller 22 (see FIG. 5) which, in time, is driven by a motor (not shown). Also, there is actuation of a vacuum pump (not shown) to apply a reduced pressure to the manifold 40.

As indicated above, the disclosed method and unwind system for large diameter parent rolls is completely automated to avoid the need for manual handling of cumbersome and potentially dangerous rolls. At the outset, the cart 26 is advantageously equipped with an upper table 57 (see FIG. 2) which is rotatable about a vertical axis through an arc of 90° to permit cantilever delivery of a new parent roll whose axis is parallel to the length of the web path, i.e., from cart 26 to bonding station 23. The controller 27 thereupon causes the table 57 to rotate to the position shown in FIGS. 2 and 3 for commencing the unwind cycle. As the previous parent roll nears expiration, the arm means 21, which have been detached from the previous roll core are automatically pivoted from downstream to upstream and the chucking of the core performed automatically as described above. Then, at the end of the cycle, the depleted core is deposited on the table 25 and the arm means 21 unchucked for the initiation of another cycle.

Figure 16:
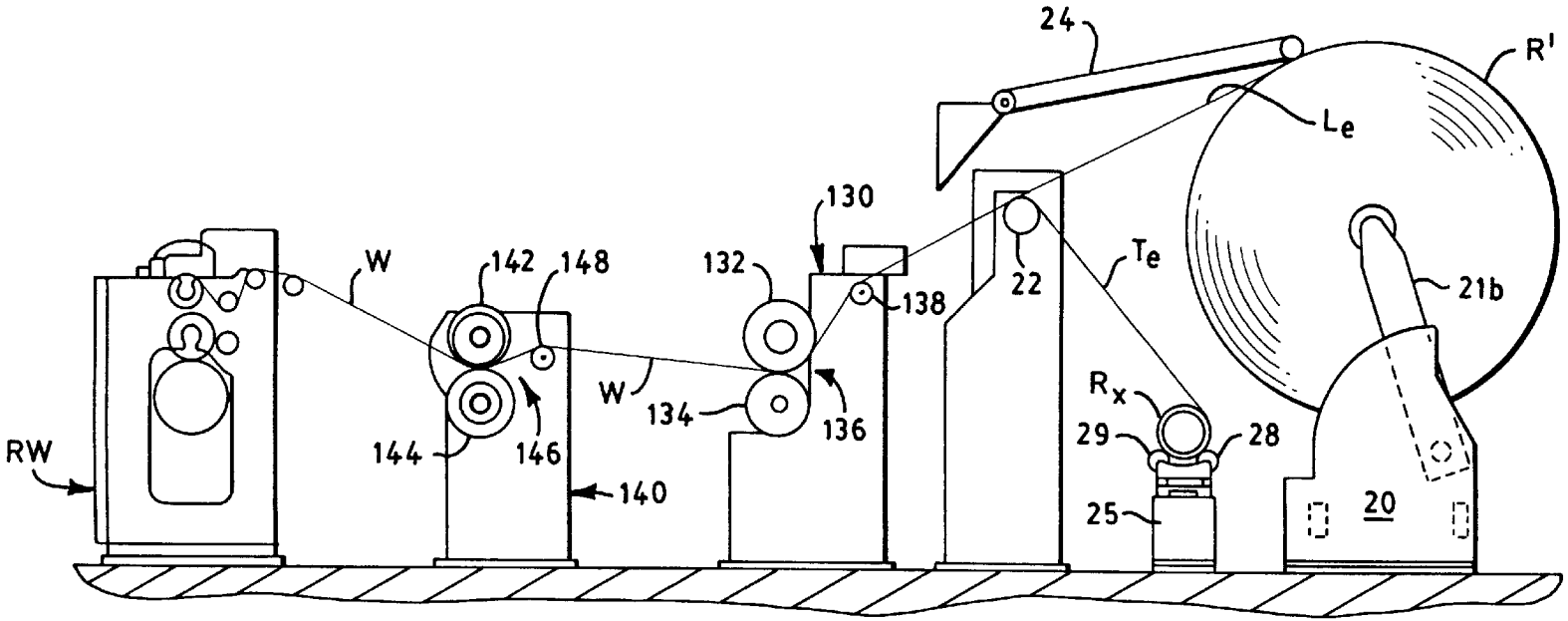
FIG. 16 is a partial schematic process flow diagram illustrating a method of splicing webs together utilizing a finishing unit.

FIG. 16 illustrates an automated off-line method for splicing tissue webs from different parent rolls for subsequent rewinding. The method utilizes a finishing unit that substantially continuously impacts each web during unwinding to form the splice between the webs. As illustrated, an expiring roll $R_x$ has been deposited on the core placement table 25. The web W from the expiring roll $R_x$ is desirably transported in sequence to a calendering unit 130 and an embossing unit 140. Either the calendering unit or the embossing unit substantially continuously impacts the web W during the time that the web is unwound from its parent roll $R_x$. The calendered and embossed tissue web W may then be wound at a rewinding unit RW. For example, the tissue web W may be wound onto tissue roll cores to form logs, which are subsequently cut into appropriate widths and the resulting individual tissue rolls are packaged (not shown).

The calendering unit 130 comprises a pair of calendering rolls 132 and 134 that together define therebetween a calendering nip 136. A spreader roll 138 is shown preceding the calendering nip 136, although other details of the calendering unit 130 are not shown for purposes of clarity.

The calendering nip 136 may comprise a "soft-nip" wherein the rolls have different surface hardnesses and at least one of the rolls has a resilient surface. Resilient calendering rolls suitable for the present invention are typically referred to as rubber covered calendering rolls, although the actual material may comprise natural rubber, synthetic rubber, composites, or other compressible surfaces. Suitable resilient calendering rolls may have a Shore A surface hardness from about 75 to about 100 Durometer (approximately 0 to 55 Pusey & Jones), and particularly from about 85 to about 95 Durometer (approximately 10 to 40 Pusey & Jones). For instance, the calendering rolls may comprise a smooth steel roll 134 and a smooth resilient roll 132 formed of a composite polymer such as that available from Stowe Woodward Company, U.S.A., under the tradename MULTICHEM. The calendering nip pressure is suitably from about 30 to about 200 pounds per lineal inch, and more particularly from about 75 to about 175 pounds per lineal inch. Creped throughdried webs desirably have the sheet orientation for calendering and embossing as disclosed in copending U.S. patent application Ser. No. 08/876,548, filed Jun. 16, 1997, now abandoned, by R. Jennings et al. and titled "Sheet Orientation For Soft-Nip Calendering And Embossing Of Creped Throughdried Tissue Products."

Upon exiting the calendering unit 130, the tissue web W is transported to an embossing unit 140 comprising a pattern roll 142 and a backing roll 144. The pattern and backing rolls 142 and 144 together define therebetween an embossing nip 146. A spreader roll 148 is shown preceding the embossing nip 146, although other details of the calendering unit 130 are not shown for purposes of clarity.

Embossing is a well-known mechanism to increase sheet caliper, and it also provides an additional benefit by imparting a decorative pattern to the tissue product. These decorative patterns may comprise "spot embossing" or "spot embossments" which include discrete embossing elements. Such elements may be about 0.5 inch by 0.5 inch to about 1 inch by 1 inch in size, and thus from about 0.25 to about 1 square inch in surface area. These discrete embossing elements are typically spaced about 0.5 inch to about 1 inch apart. The spot embossing elements are formed on a pattern roll, which is also referred to as an embossing roll, and are pressed into the tissue sheet. The spaced-apart discrete spot embossing elements substantially continuously impact the web as it is processed through the embossing nip 146. The spot embossing elements can depict a decorative pattern such as flowers, leaves, birds, animals, and the like. As disclosed in copending U.S. patent application Ser. No. 08/876,547, filed Jun. 16, 1997, now U.S. Pat. No. 5,904,812, by Z. Salman et al. and titled "Calendered And Embossed Tissue Products," high-bulk tissue products can be embossed with improved pattern clarity by processing the high bulk tissue webs sequentially through separate calendering and embossing units.

The backing roll 144 may comprise a smooth rubber covered roll, an engraved roll such as a steel roll matched to the pattern roll, or the like. The embossing nip may be set to a pattern/backing roll loading pressure from about 80 to about 150 pounds per lineal inch, for example an average of about 135 pounds per lineal inch, such that the embossing pattern is imparted to the tissue web W. The backing roll can be any material that meets the process requirements such as natural rubber, synthetic rubber or other compressible surfaces, and may have a Shore A surface hardness from about 65 to about 85 Durometer, such as about 75 Durometer.

A new parent roll R' is shown in FIG. 16 being automatically threaded into the finishing line. Rotation of the new parent roll is effected through the core chucks 31 (not shown), which are mounted on the arms 21 and thereby connected to the frame 20. As illustrated, the leading end $L_e$ of the new web has already been transported by the thread-up conveyor 24 and deposited onto the trailing end portion $T_e$ of the nearly expired web W. The web W from the expiring roll $R_x$ preferably passes over a roller 22 and follows a downward path thereafter to the first finishing unit. The leading end $L_e$ of the new web may then be deposited onto the nearly expired web W at the location of the roller 22 or downstream of the roller 22 to facilitate travel of both webs to the first finishing unit. As described previously, the thread-up conveyor 24 is desirably operated in conjunction with rotation of the core chucks 31, and possibly rotation of the roller 22 as well. The roller 22 is desirably a driven roller with a high frictional cover, formed for example of loop material as used in engaging hook-and-loop materials, or the like.

Thus, the webs from both the expiring roll $R_x$ and the new roll R' are transported to the first finishing unit, which in this case is the calendering unit 130. The webs are not bonded together prior to the calendering unit 130, and as a result they are said to be moveable relative to one another upstream of the calendering unit. The process for automatically splicing the webs together involves simultaneously unwinding both webs from their respective parent rolls and simultaneously passing both webs through the finishing unit nip 136 to bond the webs together. In the illustrated embodiment, the parent rolls $R_x$ and R' are simultaneously driven by the cradle roller 28 and the core chucks 31. Thereafter, the web from the expiring roll $R_x$ may be broken and the new web may be substantially continuously impacted by the calendering unit or the embossing unit while the web is unwound.

The present method of splicing webs together from different parent rolls using the first finishing operation eliminates the need for separate bonding units and eliminates the need for external bonding means such as glue, tape, or the like. This method also replaces manual methods such as threading each new web or tying webs together.

In the illustrated embodiment, the first finishing operation is the calendering unit, which is used substantially continuously while the tissue webs are unwound. The first finishing operation after the unwind could alternatively be an embossing unit, a crimping unit, or other such device that impacts each individual tissue web while it is being unwound, and bonds the overlapping webs together during a web splice such that the webs are held together to the rewinder. The method dramatically reduced the down time associated with splicing different parent roll webs together compared to prior methods.

Figure 18:
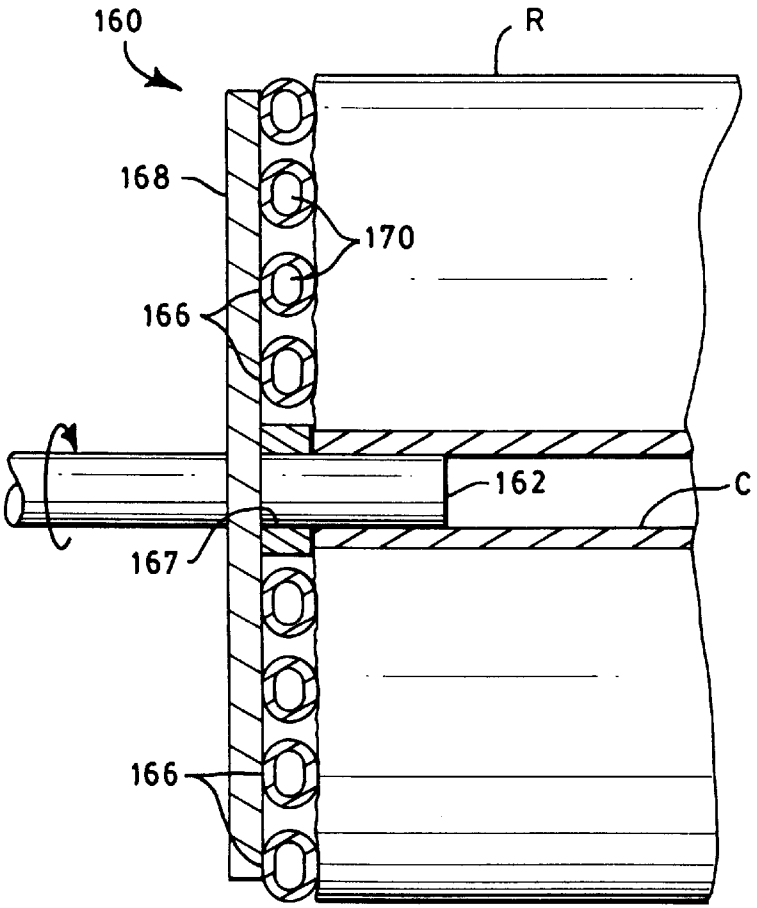
FIG. 18 is a partial longitudinal section view similar to FIG. 17 but illustrating an alternative torque transfer means employing a plurality of inflatable bladders.
Figure 17:
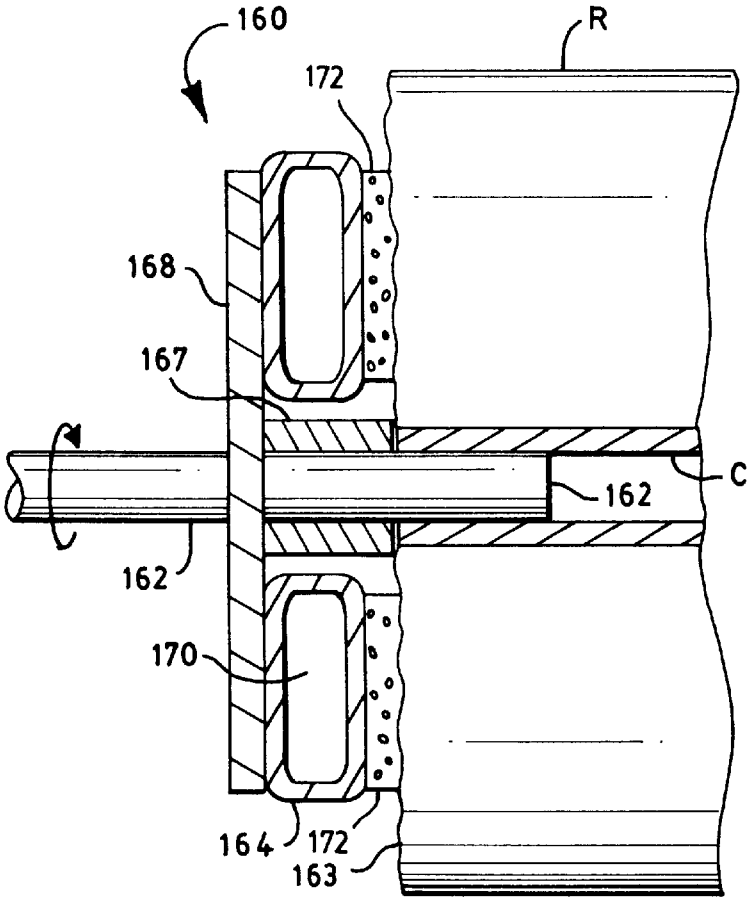
FIG. 17 is a partial longitudinal section view of a torque transfer means for transmitting torque from the unwind shaft through the roll via a side clamping mechanism, and in particular, an inflatable bladder.
Figure 19:
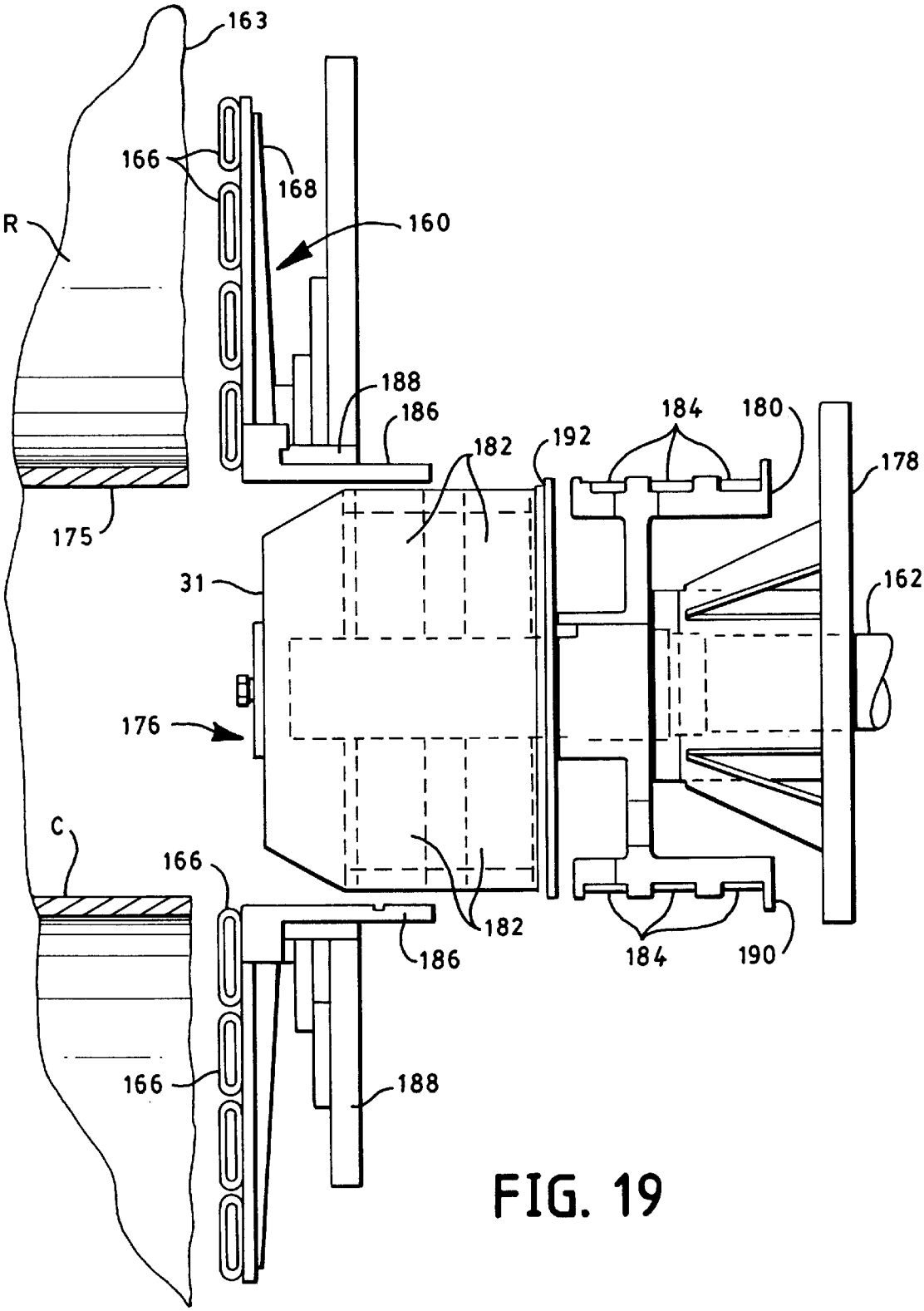
FIG. 19 is a partial longitudinal section view of another alternative torque transfer means, with portions broken away for purposes of illustration.

Other forms of torque transmitting means that do not contact the outer circumferential surface of the parent roll are described in relation to FIGS. 17–19. In FIGS. 17 and 18, the torque transfer means comprise side clamping mechanisms that engage only the opposite end surfaces of the parent roll and sandwich the roll therebetween. Such side clamping mechanisms may be used as the sole unwind devices or as supplemental devices in combination with a center-unwind drive (not shown). The torque transfer means 160 shown in FIGS. 17 and 18 are operable to transmit torque from an unwind shaft 162 through a parent roll R. The torque transfer means 160 apply pressure against the end surfaces 163 of the roll R using an inflatable annular bladder 164 (FIG. 17) or alternatively a plurality of inflatable annular bladders 166 (FIG. 18). The roll core C is positioned over the end of the shaft 162 and against a ring 167.

The inflatable bladders 164 and 166 are attached to a backing plate 168 that is fixedly attached to the unwind shaft 162. The bladders may be inflated and deflated by the movement of a fluid though suitable conduits (not shown) into bladder cavities 170. As a result, the inflatable bladders are capable of applying pressure to the end surfaces of the parent roll, and are capable of deflating or retracting as the parent roll unwinds. In regard to FIG. 18, the annular bladders 166 may be deflated or disengaged in series moving radially inward as the parent roll is unwound to smaller diameters so as not to interfere with the sheet as it is peeled away from the roll. The interior bladders 166 may be left inflated to continue transmitting torque through the roll at smaller roll diameters. The bladder contact pressures against the ends of the parent roll will depend on the configuration of the torque transfer means 160, but are suitably less than about 2.5 pounds per square inch (psi), particularly about 0.5 to about 2.5 psi, and more particularly less than about 1 psi, to minimize damage to the tissue web.

In FIG. 17, an optional friction plate 172 is attached to the inflatable bladder 164 to engage the end surfaces 163 of the roll R upon inflation of the bladder 164. The friction plate 172 may be formed of any material that best grips the roll using minimal pressure and causes minimal damage to the edges of the sheet, although the end surfaces of the roll are not normally used to make finished tissue products.

The size of the backing plate 168 will depend on the size of the parent rolls, but may be at least about 45 inches, such as about 45 to about 60 inches outside diameter, so as to be located where the highest forces are present. The portion of the torque transfer means 160 that contacts the end of the roll will have specified inner and outer diameters which minimize pressure on the roll, maximize contact area, or optimize the relationship between the contact area, engagement pressure, and friction characteristics of the torque transfer means.

The unwind system partially illustrated in FIG. 19 combines core chucks 31 that engage the inner surface 175 of the core C and supplemental torque transfer means 160 that engage the end surfaces 163 of the parent roll R. The unwind system includes opposed chuck shaft assemblies 176 (only one shown), which each comprise an unwind shaft 162 rotatably mounted within a hub 178 and drivingly connected to a variable speed drive (not shown). Each chuck shaft assembly 176 also comprises a core chuck 31 and a supplemental drive chuck 180, both of which are mounted on the shaft 162 to rotate therewith. The core chucks 31 include inflatable core chuck bladders 182 that are adapted to frictionally engage the inner core surface 175 when the chuck shaft assembly 176 is inserted into the core C. The supplemental drive chuck 180 includes inflatable coupling bladders 184, the operation of which is described hereinafter. Conduits (not shown) within the chuck shaft assembly 176 operably connect the cavities of the core chuck bladders 182 and coupling bladders 184 to a fluid source (not shown) for inflating and deflating the bladders.

The supplemental torque transfer means 160 includes an annular backing plate 168. A plurality of concentric, inflatable annular bladders 166 are attached to the backing plate and adapted to engage the end surfaces 163 of a parent roll R, shown in close proximity to the chuck shaft assembly 176 for purposes of illustration. The backing plate 168 includes an integral, axially extending collar 186 that is releasably attached by spring balls and detents or other suitable means (not shown) to a portion of the fixed frame 188. Conduits (not shown) within the backing plate 168 and chuck shaft assembly 176 and connected by a rotary joint operatively connect the cavities of the annual bladders 166 to a fluid source (not shown).

Once the core chucks 31 are aligned for insertion into a core C, the chuck shaft assemblies 176 are axially advanced toward one another into the roll R. Axial movement is temporarily halted when the supplemental drive chucks 180 are radially inward of the backing plate collars 186, at which point flanges 190 of the supplemental drive chucks 180 may contact the collars. The coupling bladders 184 are then inflated to frictionally engage the backing plate collars 186. The chuck shaft assemblies 176 then resume their axial advance until the core chucks 31 are within the core C and flanges 192 of the core chucks abut the core. Both the bladders 182 within the core chucks 31 and the annular bladders 164 on the backing plates 168 are then inflated to engage the inner surface 175 of the core and the end surfaces 163 of the parent roll. Alternatively, the supplemental torque transfer means 160 and chuck shaft assembly 176 could be fixedly connected (not shown).

The supplemental torque transfer means 160 described in relation to FIGS. 16–19 are particularly beneficial for use with loosely-wound parent rolls having an outside diameter of about 120 inches or greater, for example about 140 inches or greater. The supplemental torque transfer means reduces or eliminates slippage between individual sheet layers and between sheet layers and the inner roll core, particularly during high acceleration or deceleration periods. The desired level of torque can be transferred from the unwind shaft through the roll itself by selection of the coefficient of friction of the side clamping mechanism, the contact area of the side clamping mechanism, and the air pressure of the bladders.

While in the foregoing specification, a detailed description of various embodiments of the invention have been set down for the purpose of illustration, many variations in the details hereingiven may be made by those skilled in the art without departing from the spirit and scope of the invention.

We claim:

1. A method of making and processing a high bulk tissue web, comprising:

depositing an aqueous suspension of papermaking fibers onto an endless forming fabric to form a web;

drying the web to form a dried web having a bulk of 9.0 cubic centimeters per gram or greater;

winding the dried web to form a plurality of parent rolls each comprising a web wound on a core;

transporting the parent rolls to an unwind stand comprising a pair of spaced apart arms, each arm comprising torque transmitting means for engaging a parent roll;

engaging the torque transmitting means with a first parent roll;

partially unwinding the first parent roll using variable speed drive means operably associated with the torque transmitting means;

rotatably supporting the partially unwound first parent roll on a core placement table that is adapted to receive the partially unwound first parent roll from the arms;

engaging the torque transmitting means with a second parent roll;

bonding a leading end portion of the web on the second parent roll to a trailing end portion of the partially unwound first parent roll to form a joined web; and rewinding the joined web.

2. A method of making and processing a high bulk, uncreped throughdried tissue web, comprising:

depositing an aqueous suspension of papermaking fibers onto an endless forming fabric to form a web;

transferring the web to a throughdrying fabric;

throughdrying the web to form an uncreped throughdried web having a bulk of 6.0 cubic centimeters per gram or greater;

winding the dried web to form a plurality of parent rolls each comprising an uncreped throughdried web wound on a core;

transporting the parent rolls to an unwind stand comprising a pair of spaced apart arms, each arm comprising torque transmitting means for engaging a parent roll;

engaging the torque transmitting means with a first parent roll;

partially unwinding the first parent roll using variable speed drive means operably associated with the torque transmitting means;

rotatably supporting the partially unwound first parent roll on a core placement table that is adapted to receive the partially unwound first parent roll from the arms;

engaging the torque transmitting means with a second parent roll;

bonding a leading end portion of the web on the second parent roll to a trailing end portion of the partially unwound first parent roll to form a joined web; and rewinding the joined web.

3. The method of claim 1 or 2, further comprising transporting the leading end portion of the web on the second parent roll with a thread-up conveyor.

4. The method of claim 3, further comprising transporting the leading end portion of the web with vacuum means operably associated with an endless screen belt means.

5. The method of claim 4, further comprising transporting the leading end portion of the web on the second parent roll with decreasing amounts of vacuum as the web is transported over the endless screen belt means.

6. The method of claim 3, further comprising moving the thread-up conveyor relative to the second parent roll between an active position and a standby position.

7. The method of claim 3, further comprising moving the thread-up conveyor into close proximity or contact with the second parent roll.

8. The method of claim 7, further comprising operating the thread-up conveyor and unwinding the second parent roll at a same surface speed.

9. The method of claim 1 or 2, further comprising routing the web of the first parent roll over a roller and then to a bonding unit.

10. The method of claim 3, further comprising moving the thread-up conveyor and the core placement table to standby positions while the parent rolls are being unwound.

11. The method of claim 2, wherein the uncreped throughdried web has a bulk of about 9 cubic centimeters per gram or greater.

12. The method of claim 1 or 2, wherein the dried web has a bulk in the range from about 10 to about 35 cubic centimeters per gram.

13. The method of claim 1 or 2, wherein each parent roll has a circumferential surface, opposite end surfaces, and a core inner surface, and the torque transmitting means comprises retractable chuck means that engage the core inner surfaces of the parent rolls.

14. The method of claim 1 or 2, wherein each parent roll has a circumferential surface, opposite end surfaces, and a core inner surface, and the torque transmitting means comprises clamping means that engage the opposite end surfaces of the parent rolls.

15. The method of claim 1 or 2, wherein the parent roll cores have an outside diameter of at least about 14 inches and the parent rolls have an outside diameter of at least about 60 inches and a width of at least about 55 inches.

16. The method of claim 1 or 2, wherein the core placement table comprises drive motor means for rotating the partially unwound first parent roll while disposed thereon.

17. The method of claim 16, further comprising energizing the variable speed drive and the drive motor means to simultaneously unwind the webs on both the first and second parent rolls.

18. The method of claim 1 or 2, wherein the unwind stand comprises a frame and the arms are pivotally mounted on the frame.

19. The method of claim 1, further comprising: moving the first parent roll to an unwind position for partially unwinding the first parent roll; moving the first parent roll to a position in close proximity to or contact with the core placement table; and moving the second parent roll to an unwind position for partially unwinding the second parent roll.

20. The method of claim 1 or 2, further comprising discharging the leading end portion of the web of the second parent roll onto the web from the partially unwound first parent roll.

21. The method of claim 20, further comprising simultaneously unwinding the partially unwound first parent roll and the second parent roll at the same surface speed.

22. The method of claim 1 or 2, further comprising:

transporting the web from the first parent roll to a finishing unit comprising rolls defining a finishing unit nip;

thereafter substantially continuously impacting the web from the first parent roll in the finishing unit nip while the web is unwound from the first parent roll;

transporting the web from the second parent roll to the finishing unit;

simultaneously passing the webs from both the first and second parent rolls through the finishing unit nip to bond the webs together; and thereafter substantially continuously impacting the web from the second parent roll in the finishing unit nip while the web is unwound from the second parent roll.

23. The method of claim 22, wherein the finishing unit comprises an embossing unit.

24. The method of claim 22, wherein the finishing unit comprises a calendering unit.

* * * * *